US010622755B1

(12) United States Patent
Gonzalez Delgadillo et al.

(10) Patent No.: US 10,622,755 B1
(45) Date of Patent: Apr. 14, 2020

(54) CONNECTOR ASSEMBLY AND METHOD OF ASSEMBLING SAME

(71) Applicant: Aptiv Technologies Limited, St. Michael (BB)

(72) Inventors: Carlos A. Gonzalez Delgadillo, Saltillo (MX); Jorge I. Escamilla Rodriguez, Saltillo (MX); Pedro Yabur Pacheco, Saltillo (MX)

(73) Assignee: Aptiv Technologies Limited (BB)

( * ) Notice: Subject to any disclaimer, the term of this patent is extended or adjusted under 35 U.S.C. 154(b) by 0 days.

(21) Appl. No.: 16/294,998

(22) Filed: Mar. 7, 2019

(51) Int. Cl.

| | |
|---|---|
| ***H01R 4/18*** | (2006.01) |
| ***H01R 13/52*** | (2006.01) |
| ***H01R 43/20*** | (2006.01) |
| ***H01R 43/00*** | (2006.01) |
| ***H01R 43/048*** | (2006.01) |

(52) U.S. Cl.
CPC ..... *H01R 13/521* (2013.01); *H01R 4/183* (2013.01); *H01R 43/005* (2013.01); *H01R 43/048* (2013.01); *H01R 43/20* (2013.01); *H01R 4/185* (2013.01); *H01R 13/5205* (2013.01); *H01R 13/5208* (2013.01)

(58) Field of Classification Search
CPC . H01R 4/185; H01R 13/5205; H01R 13/5208
See application file for complete search history.

(56) References Cited

U.S. PATENT DOCUMENTS

| | | | | |
|---|---|---|---|---|
| 7,033,216 | B2 * | 4/2006 | Ito | H01R 13/5208 439/275 |
| 7,637,764 | B2 * | 12/2009 | Yoneda | H01R 13/5208 439/275 |
| 7,883,365 | B2 * | 2/2011 | Saitou | H01R 13/5205 439/587 |
| 7,905,740 | B2 * | 3/2011 | Chazottes | H01R 13/5208 439/271 |
| 2008/0014793 | A1 * | 1/2008 | Okumura | H01R 13/5205 439/587 |

* cited by examiner

*Primary Examiner* — Tho D Ta
(74) *Attorney, Agent, or Firm* — Robert J. Myers

(57) ABSTRACT

A connector assembly includes a mat seal and a conductor seal. The mat seal is shaped to fit within an opening in a connector housing of the connector assembly. The mat seal defines at least one a seal passage extending therethrough. The conductor seal defines a conductor passage extending therethrough. The conductor seal is configured to receive conductor, such as an insulated electrical cable, within the conductor passage. The conductor seal is received within the seal passage. The mat seal and the conductor seal cooperate to inhibit intrusion of contaminants into the connector housing. A method of assembling a connector assembly having a mat seal and a conductor seal is also presented herein.

17 Claims, 7 Drawing Sheets

CONNECTOR ASSEMBLY AND METHOD OF ASSEMBLING SAME

TECHNICAL FIELD OF THE INVENTION

The invention generally relates to a connector assembly, particularly to a sealed connector assembly.

BRIEF SUMMARY OF THE INVENTION

The present invention will now be described, by way of example with reference to the accompanying drawings, in which:

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1:
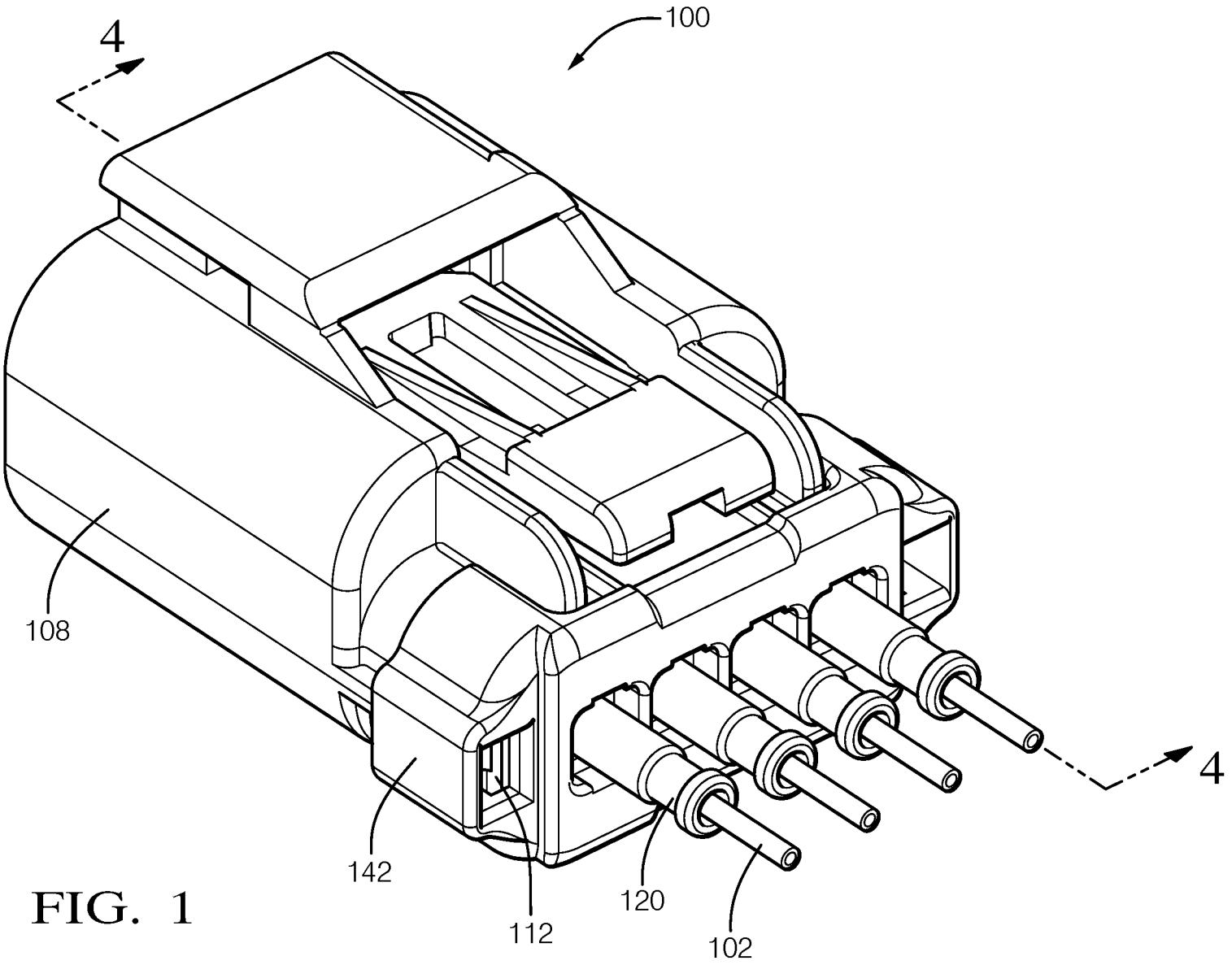
FIG. 1 is a perspective view of an electrical connector assembly according to one embodiment of the invention.

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

According to one embodiment of the invention, a connector assembly includes a mat seal that is shaped to fit within an opening in a connector housing. The mat seal defines a seal passage extending through the mat seal. The connector assembly also includes a conductor seal that defines a conductor passage extending therethrough. The conductor passage is configured to receive an end of a conductor. The conductor seal is received within the seal passage. The mat seal and the conductor seal cooperate to inhibit intrusion of contaminants into the connector housing.

The conductor may be an insulated wire cable having an electrical terminal attached thereto. The electrical terminal may have a first crimping feature attached to an inner wire of the insulated wire cable and a second crimping feature attached to the conductor seal. An outer wall of the conductor seal may define an outer groove and the second crimping feature may be disposed within the outer groove.

The conductor seal may be configured to extend beyond the connector housing when the conductor seal is fully inserted within the mat seal.

The conductor seal may be configured to inhibit bending of the end of the conductor as the conductor seal is received within the seal passage.

An inner wall of the conductor passage may define a plurality of inner grooves.

The seal passage may be a first seal passage, the conductor may be a first conductor, the conductor seal is may be first conductor seal, and the conductor passage may be a first conductor passage. The mat seal may define a second seal passage extending therethrough. The connector assembly further comprises a second conductor seal defining a second conductor passage extending therethrough and configured to receive an end of a second conductor, wherein the second conductor seal is received within the second seal passage, and wherein a first inner diameter of the first conductor passage is different than a second inner diameter of the second conductor passage. A first outer diameter of the first conductor seal may be equal to a second outer diameter of the second conductor seal. The first inner diameter of the first conductor passage may be not equal to the second inner diameter of the second conductor passage. A first diameter of the first seal passage may be equal to a second diameter of the second seal passage. The first conductor seal and the second conductor seal may be formed of a silicone-based material.

According to another embodiment of the invention, a method of forming a connector assembly includes the steps of:

- inserting an electrical cable having an elongate conductive core surrounded by an insulative sheath into a conductor seal,
- with a first crimping feature, crimping an electrical terminal to the conductive core, and
- with a second crimping feature, crimping the electrical terminal to an end of the conductor seal.

The method may further include the steps of:

- inserting a mat seal shaped to fit within an opening of a connector housing, the mat seal defining a seal passage extending therethrough;
- inserting the conductor seal within the seal passage, wherein the mat seal and the conductor seal cooperate to inhibit intrusion of contaminants into the connector housing.

The conductor seal may extend beyond the connector housing when the conductor seal is fully inserted within the mat seal.

The conductor seal may be configured to inhibit bending of the end of the electrical cable during the step of inserting the conductor seal within the seal passage.

An inner wall of the conductor passage may define a plurality of grooves. An outer wall of the conductor seal may also define a plurality of grooves.

The electrical cable may be a first electrical cable, the electrical terminal may be a first electrical terminal, the conductor seal may be a first conductor seal, and the seal passage may be a first seal passage. The mat seal may define a second seal passage extending therethrough. The method may further include the steps of:

inserting a second electrical cable having an elongate conductive core surrounded by an insulative sheath into a second conductor seal;

with a first crimping feature, crimping a second electrical terminal to the conductive core of the second electrical cable;

with a second crimping feature, crimping the second electrical terminal to an end of the second conductor seal; and inserting the second conductor seal within the second seal passage, wherein the mat seal and the second conductor seal cooperate to inhibit intrusion of contaminants into the connector housing.

A first outer diameter of the first conductor seal may be equal to a second outer diameter of the second conductor seal. A first diameter of the first conductor passage may be not equal to a second diameter of the second conductor passage. A first diameter of the first seal passage may be equal to a second diameter of the second seal passage.

The first conductor seal and the second conductor seal may be formed of a silicone-based material.

Some connector assembly have had conductors that were inserted directly into conductor passages defined by the mat seal, but this has not sufficiently addressed the needs of the industry because each conductor passage had to be sized to fit a particular cable size in connector assembly applications having a mix of conductor diameters. This often required a different mat seal to be tooled for each particular application in which the connector assembly was used. Additionally, the diameter of the conductor passage must be reduced in order for the mat seal to properly seal to the conductor as smaller diameter conductors are used. If a terminal is attached to an end of the conductor having a small diameter, e.g. having a dimeter of 0.85 mm or less, it may be too large to easily pass through the conductor passage, leading to difficult insertion of the terminal and conductor through the conductor passage due to a high insertion force caused by contact between the edges of the terminal and the conductor passage and/or damage to the mat seal also caused by contact between the edges of the terminal and the conductor passage that reduces the effectiveness of the mat seal to seal out contaminants.

FIG. 1 illustrates a nonlimiting example of a connector assembly 100 used to interconnect elongate conductors 102. In this example, the conductors are insulated wire electrical cables, hereinafter referred to as electrical cables 102. Electrical terminals 104 formed of a conductive material, such as a tin-plated copper material, are attached to ends of the electrical cables 102. These electrical terminals 104 are received and retained within terminal cavities 106 defined within a connector housing 108 of the connector assembly 100. The connector housing 108 is formed of a dielectric material, such as polyamide (PA, also known as nylon) or polybutylene terephthalate (PBT).

Figure 4:
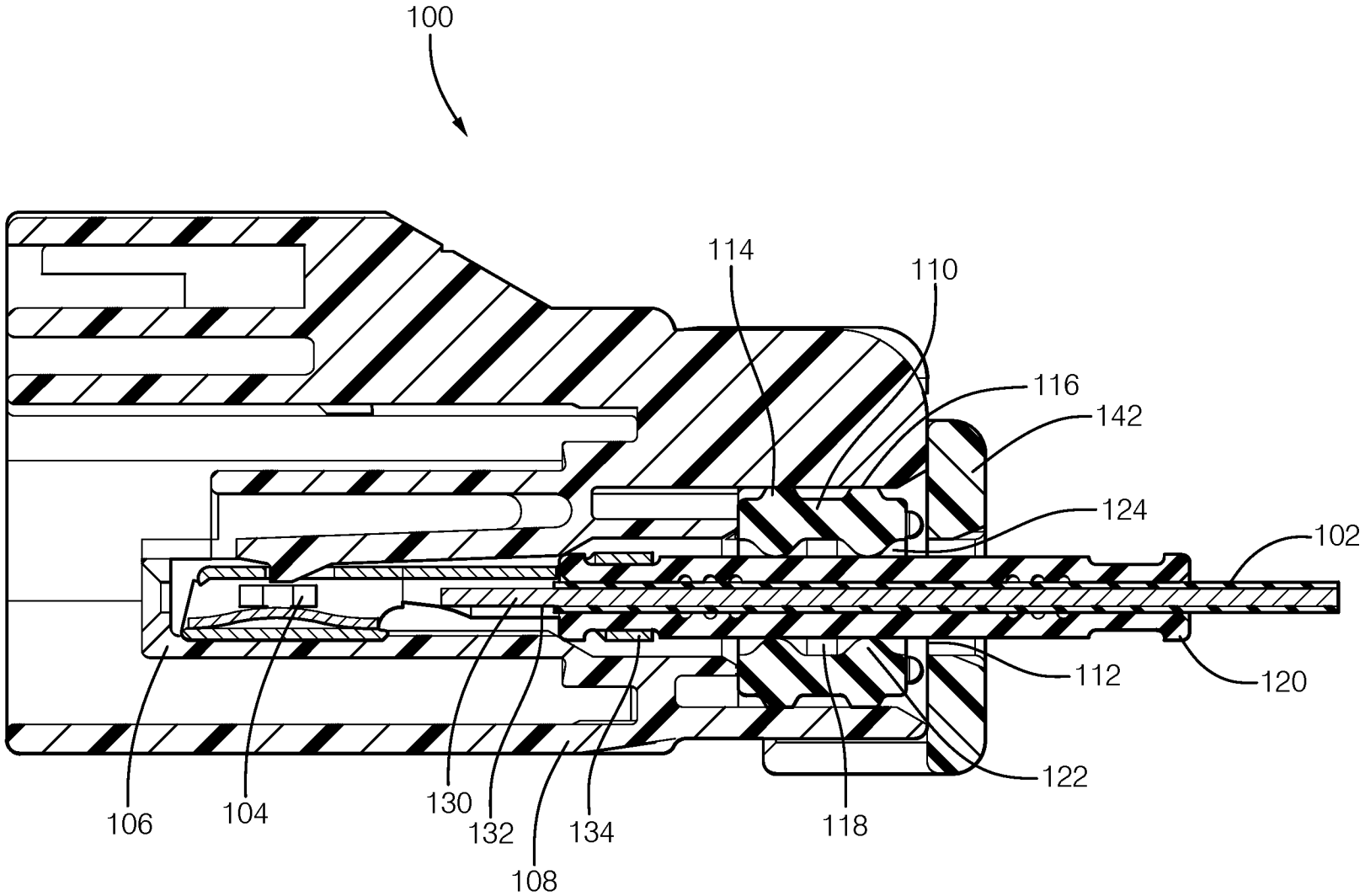
FIG. 4 is a cross section view of the electrical connector assembly of FIG. 1 according to one embodiment of the invention.

The connector assembly 100, as shown in the nonlimiting example of FIG. 4, includes a mat seal 110 that is configured to inhibit the intrusion of contaminants, such as water, oil, or dirt, through a rear opening 112 of the connector housing 108 into the terminal cavity 106. The mat seal 110 may include a mat formed of an elastomeric material, e.g. silicone rubber, that is shaped to fit within and across the rear opening 112 of the connector housing 108.

The mat seal 110 includes defines forward and aft peripheral edge sealing ribs 114 that are arranged parallel to one another and are axially-spaced from one another. The peripheral edge sealing ribs inhibit contaminants from passing between an outer periphery of the mat seal 110 and a corresponding inner sealing surface 116 of the connector housing 108. Each of the peripheral sealing ribs 114 extends integrally edgewise outward from around the mat seal 110 so that the peripheral sealing ribs 114 will be elastically compressed when the mat seal 110 is received within the rear opening 112 and will seal against the inner sealing surface 116 of the connector housing 108 into which the mat seal 110 has been received.

The mat seal 110 may also include a plurality of seal passages 118. The seal passages 118 each configured to receive insertion of a conductor seal 120, hereinafter referred to as a cable seal 120. The cable 120 seal is characterized as having a generally cylindrical shape. Each seal passage 118 includes forward and aft annular sealing ribs 122 that extend radially and integrally inwardly from around a major diameter of each seal passage 118. Each annular sealing rib 122 includes a circular aperture 124 that is smaller in diameter than the cable seal 120. Because the diameter of the annular sealing rib 122 is smaller than that the cable seal's diameter, each of the circular apertures 124 of the annular sealing ribs 122 wi11 be elastically enlarged when receiving the cable seal 120 and will constrict around and seal against the outer surface of the cable seal 120. The annular sealing ribs 122 inhibit contaminants from passing between an outer periphery of the cable seal 120 and the mat seal 110.

Figure 2A:
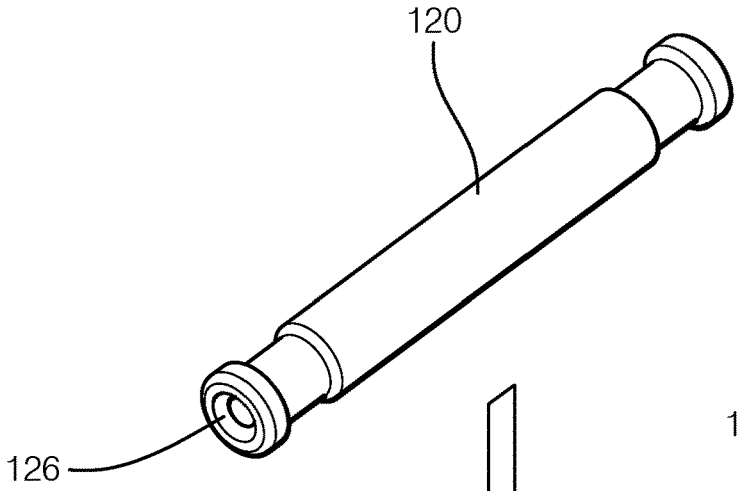
FIGS. 2A through 2C are perspective progressive views of a process of inserting a conductor within a conductor seal and crimping a terminal to the conductor and the conductor seal of the electrical connector assembly of FIG. 1 according to one embodiment of the invention.

As illustrated in the nonlimiting example of FIG. 2A, the cable seal 120 has a generally cylindrical shape. The cable seal 120 is formed of an elastomeric material, such as silicone rubber. The cable seal 120 defines a conductor passage 126, hereinafter referred to as a cable passage 126, that extends longitudinally through the cable seal 120. The cable passage 126 may be shaped to inhibit contaminants from passing between an inner periphery of each cable passage 126 and an insulative sheath 128 of the electrical cable 102. The cable seal 120 is configured to be received in one of the seal passages 118 of the mat seal 110.

Figure 2B:
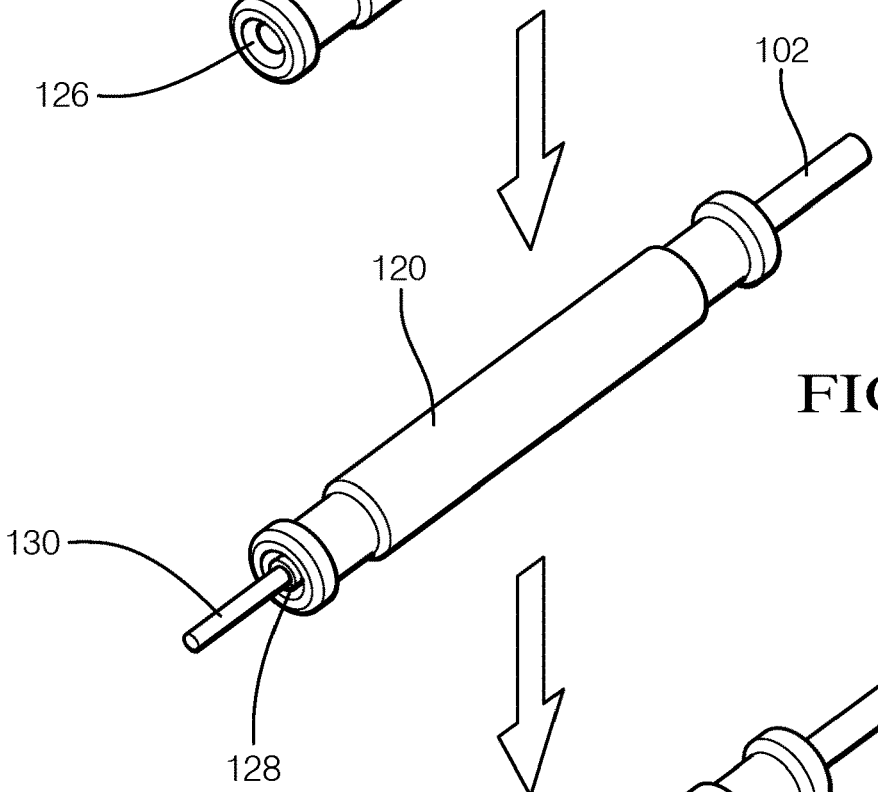

As illustrated in the non-limiting example of FIG. 2B, an end of one of the electrical cables 102 is received within the cable passage 126. In the example of FIG. 2B, the insulative sheath 128 of the electrical cable 102 is removed to expose the electrically conductive core 130. The cable passage 126 is smaller in diameter than the electrical cable 102. Because the diameter of cable passage 126 is smaller than the cable's diameter, the cable passage 126 will be elastically enlarged when receiving the electrical cable 102 and will constrict around and seal against the insulative sheath 128 of the electrical cable 102.

Figure 2C:
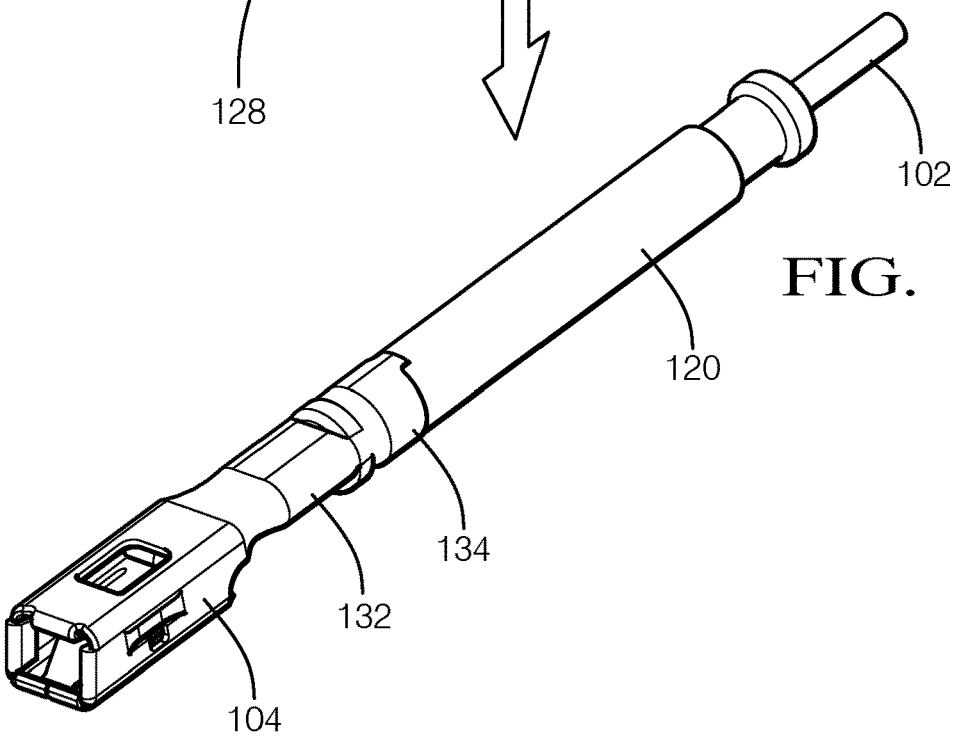

As shown in FIG. 2C, an electrical terminal 104 is attached to the end of the electrical cable 102. The electrical terminal 104 defines two different crimping features. The first crimping feature 132, hereinafter referred to as core crimping wings 132 are wrapped about the conductive core 130 of the electrical cable 102 and crimped to electrically and mechanically attach the electrical terminal 104 to the conductive core 130. The second crimping feature 134, hereinafter referred to as seal crimping wings 134 are wrapped about the cable seal 120 and crimped to mechanically attach the electrical terminal 104 to the cable seal 120. The cable seal 120 defines annular crimp wing grooves 136 in the outer surface arranged symmetrically near each end the cable seal 120. The seal crimping wings 134 are disposed in one of these crimp wing grooves 136 in the outer surface of the cable seal 120. The crimp wing grooves 136 improve mechanical retention of the seal crimping wings 134 to the cable seal 120. The crimp wing grooves 136 are symmetrically defined in both ends of the outer surface of the cable seal 120 even though only one crimp wing groove 136 is used to receive the seal crimping wings 134 so that it is not necessary to orient a particular end of the cable seal 120 when the electrical cable 102 is inserted within the cable passage 126 to provide a crimp wing groove 136 for the seal crimping wings 134.

Figure 3A:
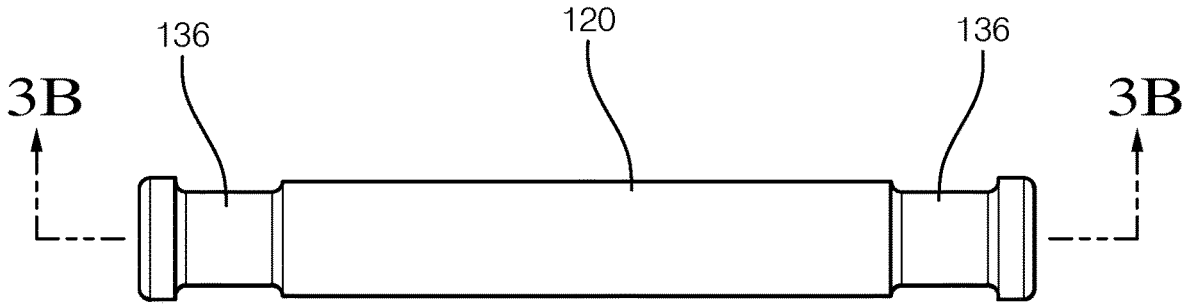
FIG. 3A is a side view of the conductor seal according to one embodiment of the invention.
Figure 3B:
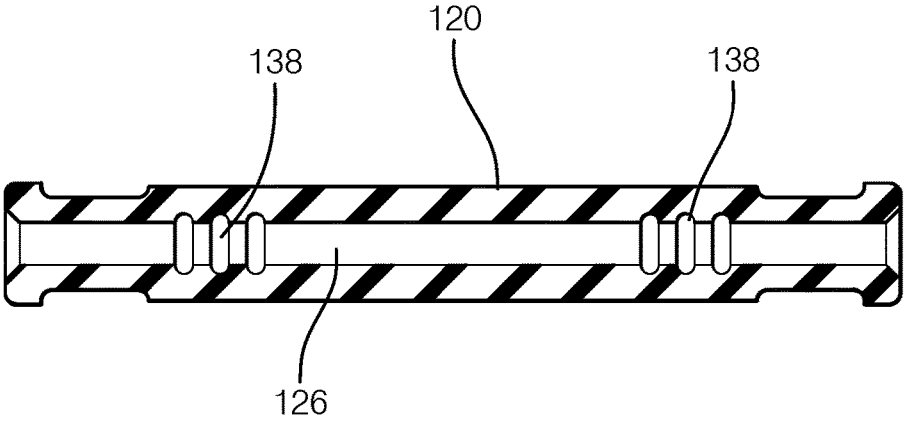
FIG. 3B is a cut away view of the conductor seal of FIG. 3A according to one embodiment of the invention.

As illustrated in the nonlimiting example of FIG. 3B, the inner walls of the cable passage 126 define a plurality of annular grooves 138 that extend inwardly from the inner surface of each cable passage 126. The annular grooves 138 reduce the friction between the cable seal 120 and the insulative sheath 128 during the insertion of the electrical cable 102 within the cable passage 126. The annular grooves 138 also reduce the deformation of the cable seal 120 when crimping the seal crimping wings 134 to the cable seal 120 and improve the sealing capability to the electrical cable 102.

Figure 5A:
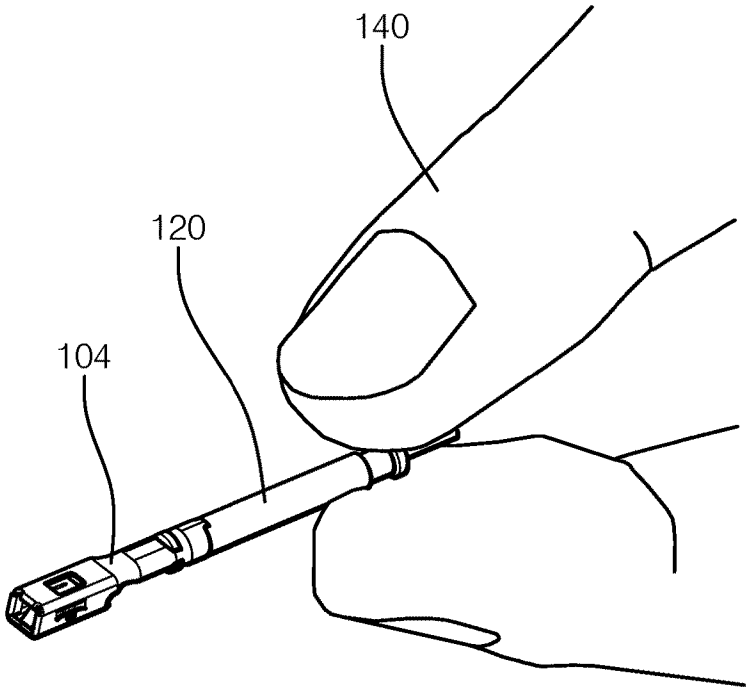
FIG. 5A is a perspective view of an assembly technician gripping the conductor seal of FIG. 2C according to one embodiment of the invention.
Figure 5B:
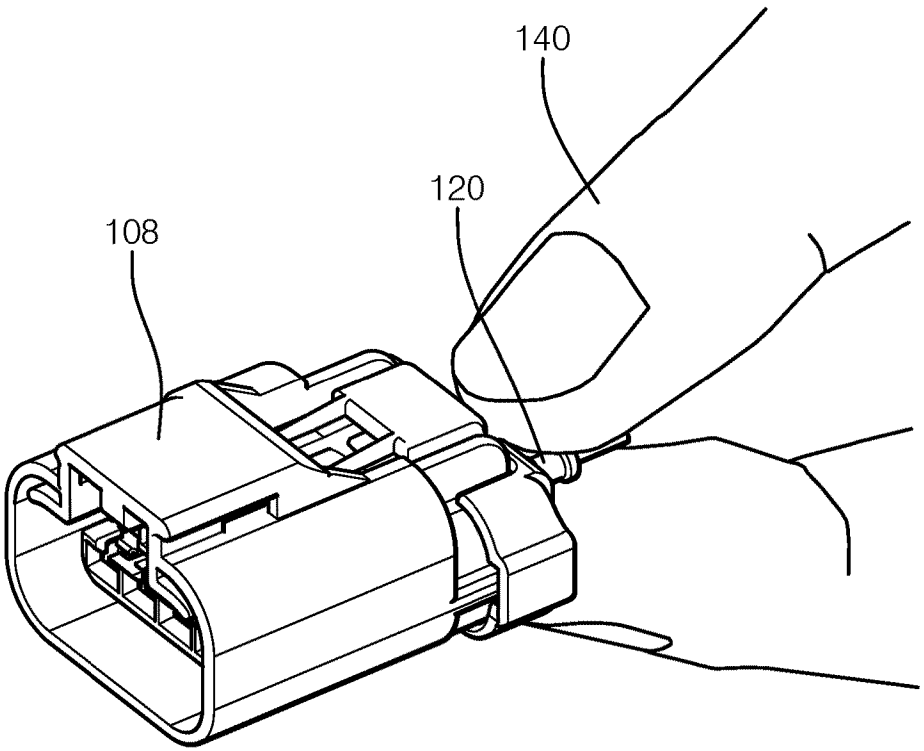
FIG. 5B is a perspective view of the assembly technician inserting the conductor seal of FIG. 2C into the connector assembly of FIG. 1 according to one embodiment of the invention.

As shown in the nonlimiting example of FIG. 4, the cable seal 120 extends beyond the connector housing 108 when the cable seal 120 is fully inserted within the mat seal 110. This allows an assembly technician 140 to grip the cable seal 120 as the electrical terminal 104 is inserted within the connector housing 108 as shown in FIGS. 5A and 5B. The cable seal 120 increases the column strength of the electrical cable 102 so that it is more likely that the electrical cable 102 can resist buckling during the application of increased insertion force to seat the electrical terminal 104 within the terminal cavity 106.

As illustrated in FIG. 1, the connector assembly 100 accommodates a plurality of electrical cables 102 and accordingly the mat seal 110 defines a plurality of seal passages 118. According to this nonlimiting example, each of the seal passages 118 have the same internal diameter and each of the cable seals 120 have the same external diameter. Different diameter electrical cables 102 are accommodated by having individual cable seals 120 with electrical cable 102 passages of different diameter. This allows a single mat seal design to be used with a wide variety of electrical cables 102 with different diameters.

The outer diameter of the cable seal 120 may be selected based on the size of the electrical terminal 104 to ensure that the inner diameter of the seal passage 118 is greater than the largest cross sectional dimension of the electrical terminal 104 so that the seal passage 118 can accept the electrical terminal 104 without the need for the electrical terminal 104 to deform the seal passage 118.

According to the non-limiting example best illustrated in FIG. 4, the connector assembly 100 further includes a seal retainer 142 that is configured to retain the mat seal 110 within the connector housing 108.

Figure 6:
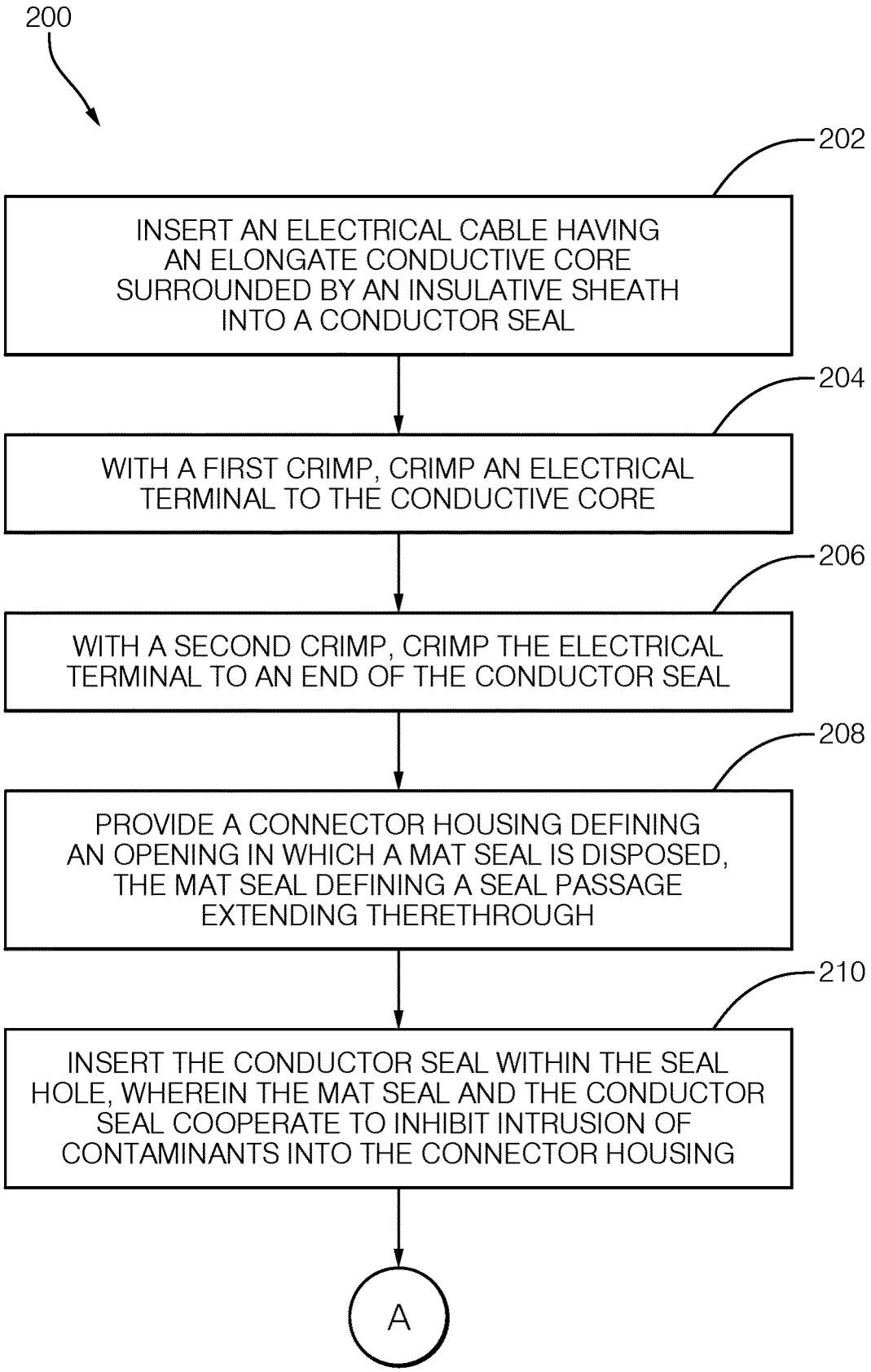
FIG. 6 is a flow chart of a method of manufacturing an electrical connector assembly according to another embodiment of the invention.
Figure 6:
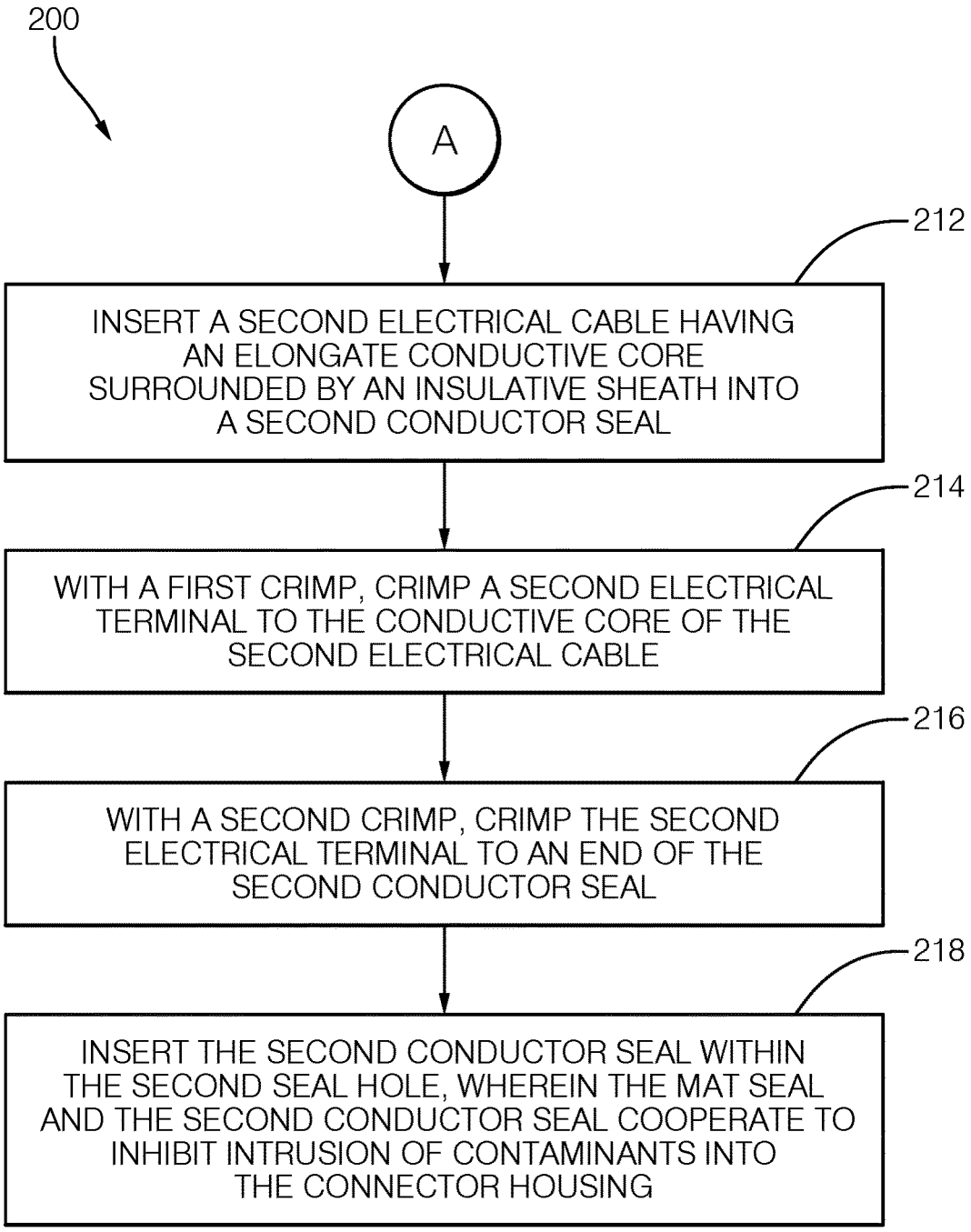

FIG. 6 illustrates a non-limiting example of a method 200 of manufacturing a connector assembly 100, such as the connector assembly 100 shown in FIG. 1. The method 200 includes the following steps:

STEP 202 inserting an electrical cable 102 having an elongate conductive core 130 surrounded by an insulative sheath 128 into a conductor seal 120 as shown in the transition from FIG. 2A to FIG. 2B;

STEP 204 includes with a first crimping feature 132, crimping an electrical terminal 104 to the conductive core 130 as shown in FIG. 2B;

STEP 206 is includes with a second crimping feature 134, crimping the electrical terminal 104 to an end of the conductor seal 120 as shown in FIG. 2B;

STEP 208 includes providing a connector housing defining an opening 112, in this nonlimiting example a rear opening, in which a mat seal 110 is disposed, the mat seal 110 defining a seal passage 118 extending therethrough as shown in FIG. 4;

STEP 210 includes inserting the conductor seal 120 within the seal passage 118, wherein the mat seal 110 and the conductor seal 120 cooperate to inhibit intrusion of contaminants into the connector housing 108 as shown in FIGS. 3A, 3B, and 4;

STEP 212 includes inserting a second electrical cable 102 having an elongate conductive core 130 surrounded by an insulative sheath 128 into a second conductor seal 120 as shown in the transition from FIG. 2A to FIG. 2B;

STEP 214 includes with a first crimping feature 132, crimping a second electrical terminal 104 to the conductive core 130 of the second electrical cable 102 as shown in FIG. 2B;

STEP 216 includes with a second crimping feature 134, crimping the second electrical terminal 104 to an end of the second conductor seal 120 as shown in FIG. 2B; and STEP 218 includes inserting the second conductor seal 120 within the second seal passage 118, wherein the mat seal 110 and the second conductor seal 120 cooperate to inhibit intrusion of contaminants into the connector housing 108 as shown in FIGS. 3A, 3B, and 4.

The example presented herein is directed to a connector assembly 100 in which the conductors 102 are insulated electrical cables 102. However, alternative embodiments of the connector assembly may be envisioned in which the conductors 102 are fiber optic cables, pneumatic tubes, hydraulic tubes, or a hybrid assembly having a combination of any of these conductors 102. These conductors 102 may be terminated by fittings which may be characterized as terminals.

Accordingly, a connector assembly 100 and a method 200 of manufacturing a connector assembly is presented. The connector assembly 100 may provide significant benefits in comparison to other connector assembly structures. For example, the connector assembly 100 has a mat seal 110 in which the seal passages 118 are large enough to accommodate a terminals 104 attached to the conductors 102 without mechanical interference between the terminals 104 and the seal passages 118 when the terminals 104 are inserted through the seal passages 118 while still properly sealing the mat seal 110 to the conductor seals 120. This provides the benefit of reduced insertion force when inserting the conductor 102 through the mat seal 110. This feature improves ergonomics for the assembly technician 140 and reduces the likelihood of the conductor 102 bending as the conductor 102 is inserted. This feature also provides the benefit of reducing or eliminating the potential of damaging the mat seal 110 by contact between the terminal 104 and the seal passage 118.

The seal passages 118 of the mat seal 110 may be constructed so that all have the same diameter while the conductor 102 passages of the conductor seals 120 may have different diameters to accommodate conductors 102 with different diameters. This feature provides the benefit of using a single mat seal design for a wide variety of configurations with conductors 102 of differing diameters, which reduces the cost of producing the mat seal 110 because the need for different tooling to produce mat seals 110 with seal passages 118 of differing diameter is eliminated. This feature provides further cost saving by reducing the different part numbers that need to be tracked for the mat seal 110.

The conductor seals 120 also provide the benefit of increasing the column strength of the conductors 102 to further reduce or eliminate bending of the conductor 102 as the assembly technician 140 inserts the conductor 102 through the mat seal 110. This is especially beneficial for conductors 102 having a small diameter.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'one or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, while terms of ordinance or orientation may be used herein these elements should not be limited by these terms. All terms of ordinance or orientation, unless stated otherwise, are used for purposes distinguishing one element from another, and do not denote any particular order, order of operations, direction or orientation unless stated otherwise.

We claim:

1. A connector assembly, comprising:

a mat seal shaped to fit within an opening in a connector housing, the mat seal defining a seal passage extending therethrough; and a conductor seal defining a conductor passage extending therethrough and configured to receive an end of a conductor, wherein the conductor seal is received within the seal passage and wherein the mat seal and the conductor seal cooperate to inhibit intrusion of contaminants into the connector housing, wherein the conductor seal is configured to extend beyond the connector housing when the conductor seal is fully inserted within the mat seal.

2. The connector assembly according to claim 1, wherein the conductor seal is configured to inhibit bending of the end of the conductor as the conductor seal is received within the seal passage.

3. The connector assembly according to claim 1, wherein an inner wall of the conductor passage defines a plurality of inner grooves.

4. The connector assembly according to claim 1, wherein the conductor is an insulated wire cable having an electrical terminal attached thereto and wherein the electrical terminal has a first crimping feature attached to an inner wire of the insulated wire cable and a second crimping feature attached to the conductor seal.

5. The connector assembly according to claim 4, wherein an outer wall of the conductor seal defines an outer groove and wherein the second crimping feature is disposed within the outer groove.

6. A connector assembly, comprising:

a mat seal shaped to fit within an opening in a connector housing, the mat seal defining a seal passage extending therethrough; and a conductor seal defining a conductor passage extending therethrough and configured to receive an end of a conductor, wherein the conductor seal is received within the seal passage and wherein the mat seal and the conductor seal cooperate to inhibit intrusion of contaminants into the connector housing, wherein the seal passage is a first seal passage, the conductor is a first conductor, the conductor seal is a first conductor seal, and the conductor passage is a first conductor passage, wherein the mat seal defines a second seal passage extending therethrough, wherein the connector assembly further comprises a second conductor seal defining a second conductor passage extending therethrough and configured to receive an end of a second conductor, wherein the second conductor seal is received within the second seal passage, and wherein a first inner diameter of the first conductor passage is different than a second inner diameter of the second conductor passage.

7. The connector assembly according to claim 6, wherein a first outer diameter of the first conductor seal is equal to a second outer diameter of the second conductor seal and wherein the first inner diameter of the first conductor passage is not equal to the second inner diameter of the second conductor passage.

8. The connector assembly according to claim 6, wherein a first diameter of the first seal passage is equal to a second diameter of the second seal passage.

9. The connector assembly according to claim 6, wherein the first conductor seal and the second conductor seal are formed of a silicone-based material.

10. A method of forming an electrical connector assembly, comprising the steps of:

a) inserting an electrical cable having an elongate conductive core surrounded by an insulative sheath into a conductor seal defining a conductor passage extending therethrough;

b) with a first crimping feature, crimping an electrical terminal to the conductive core;

c) with a second crimping feature, crimping the electrical terminal to an end of the conductor seal;

d) providing a connector housing defining an opening in which a mat seal is disposed, said mat seal defining a seal passage extending therethrough; and e) inserting the conductor seal within the seal passage, wherein the mat seal and the conductor seal cooperate to inhibit intrusion of contaminants into the connector housing, wherein the conductor seal extends beyond the connector housing when the conductor seal is fully inserted within the mat seal.

11. The method according to claim 10, wherein the conductor seal is configured to inhibit bending of the end of the electrical cable during step e).

12. The method according to claim 10, wherein an inner wall of the conductor passage defines a plurality of grooves.

13. The method according to claim 10, wherein an outer wall of the conductor seal defines a plurality of grooves.

14. The method according to claim 10, wherein the electrical cable is a first electrical cable, the electrical terminal is a first electrical terminal, the conductor seal is a first conductor seal, and the seal passage is a first seal passage, wherein the mat seal defines a second seal passage extending therethrough, and wherein the method further comprises the steps of:

f) inserting a second electrical cable having an elongate conductive core surrounded by an insulative sheath into a second conductor seal;

g) with the first crimping feature, crimping a second electrical terminal to the conductive core of the second electrical cable;

h) with the second crimping feature, crimping the second electrical terminal to an end of the second conductor seal; and i) inserting the second conductor seal within the second seal passage, wherein the mat seal and the second conductor seal cooperate to inhibit intrusion of contaminants into the connector housing.

15. The method according to claim 14, wherein the first conductor seal and the second conductor seal are formed of a silicone-based material.

16. A method of forming an electrical connector assembly, comprising the steps of:

a) inserting an electrical cable having an elongate conductive core surrounded by an insulative sheath into a conductor seal defining a conductor passage extending therethrough;

b) with a first crimping feature, crimping an electrical terminal to the conductive core;

c) with a second crimping feature, crimping the electrical terminal to an end of the conductor seal;

d) providing a connector housing defining an opening in which a mat seal is disposed, said mat seal defining a seal passage extending therethrough;

e) inserting the conductor seal within the seal passage, wherein the mat seal and the conductor seal cooperate to inhibit intrusion of contaminants into the connector housing, wherein the electrical cable is a first electrical cable, the electrical terminal is a first electrical terminal, the conductor seal is a first conductor seal, and the seal passage is a first seal passage, wherein the mat seal defines a second seal passage extending therethrough, and wherein the method further comprises the steps of:

f) inserting a second electrical cable having an elongate conductive core surrounded by an insulative sheath into a second conductor seal defining a second conductor passage, wherein the connector passage is a first connector passage;

g) with the first crimping feature, crimping a second electrical terminal to the conductive core of the second electrical cable;

h) with the second crimping feature, crimping the second electrical terminal to an end of the second conductor seal; and i) inserting the second conductor seal within the second seal passage, wherein the mat seal and the second conductor seal cooperate to inhibit intrusion of contaminants into the connector housing, wherein a first outer diameter of the first conductor seal is equal to a second outer diameter of the second conductor seal and wherein a first diameter of the first conductor passage is not equal to a second diameter of the second conductor passage.

17. The method according to claim 16, wherein a first diameter of the first seal passage is equal to a second diameter of the second seal passage.

* * * * *